US008385774B2

(12) United States Patent
Imai et al.

(10) Patent No.: US 8,385,774 B2
(45) Date of Patent: Feb. 26, 2013

(54) IMAGE FORMING APPARATUS HAVING TONER CARTRIDGE

(75) Inventors: Masashi Imai, Kasugai (JP); Shougo Sato, Seto (JP); Naoya Kamimura, Ichinomiya (JP); Nao Itabashi, Nagoya (JP); Hideshi Nishiyama, Nagoya (JP); Ryuya Yamazaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 111 days.

(21) Appl. No.: 13/040,145

(22) Filed: Mar. 3, 2011

(65) Prior Publication Data

US 2011/0217069 A1 Sep. 8, 2011

(30) Foreign Application Priority Data

Mar. 5, 2010 (JP) ..... 2010-049434

(51) Int. Cl.
*G03G 15/00* (2006.01)

(52) U.S. Cl. ..... 399/110; 399/111; 399/262

(58) Field of Classification Search ..... 399/110, 399/111, 262
See application file for complete search history.

(56) References Cited

U.S. PATENT DOCUMENTS

| | | | |
|---|---|---|---|
| 2006/0067734 | A1 | 3/2006 | Igarashi et al. |
| 2008/0226339 | A1 | 9/2008 | Sato |
| 2009/0035014 | A1 | 2/2009 | Sato |
| 2009/0226205 | A1 | 9/2009 | Sato et al. |
| 2009/0297209 | A1 | 12/2009 | Nakajima et al. |
| 2010/0054800 | A1 | 3/2010 | Okabe |
| 2011/0182613 | A1 * | 7/2011 | Kamimura et al. ..... 399/110 |
| 2012/0039629 | A1 | 2/2012 | Sato |

FOREIGN PATENT DOCUMENTS

| | | | |
|---|---|---|---|
| CN | 101359209 | A | 2/2009 |
| EP | 1857887 | A1 | 11/2007 |
| EP | 2244136 | A2 | 10/2010 |

(Continued)

OTHER PUBLICATIONS

European Patent Office, Extended European Search Report for European Patent Application No. 11001743.1, dated May 20, 2011.

(Continued)

*Primary Examiner* — G. M. Hyder
(74) *Attorney, Agent, or Firm* — Baker Botts L.L.P.

(57) ABSTRACT

Each of the toner cartridges includes a case, a shutter, a first operation portion and a second operation portion. The shutter is located at an open position where the shutter opens an opening of a case when the first operation portion is located at a first position. The shutter is located at a block position the shutter blocks the opening when the first operation portion is located at a second position. The shutter is located at the open position when the second operation portion is located at a third position. The shutter is located at the block position when the second operation portion is located at a fourth position. An interference unit is configured such that a first operation portions abut the interference unit to be displaced from the second position to the first position when a holder unit is moved from a pulled out position to an accommodated position and such that the second operation portions abut the interference unit to be displaced from the third position to the fourth position when the holder unit is moved from the accommodated position to the pulled out position.

13 Claims, 10 Drawing Sheets

1

FOREIGN PATENT DOCUMENTS

| | | | |
|---|---|---|---|
| JP | 2000-242072 | A | 9/2000 |
| JP | 2003-076123 | A | 3/2003 |
| JP | 2006-098772 | A | 4/2006 |
| JP | 2008-191578 | A | 8/2008 |
| JP | 2009-210937 | A | 9/2009 |
| JP | 2009-288473 | A | 12/2009 |

OTHER PUBLICATIONS

State Intellectual Property Office of the People's Republic of China, The First Office Action for Chinese Patent Application No. 201110058691.7 (counterpart Chinese patent application), mailed Nov. 14, 2012.

* cited by examiner

IMAGE FORMING APPARATUS HAVING TONER CARTRIDGE

CROSS REFERENCE TO RELATED APPLICATION

This application claims priority from Japanese Patent Application No. 2010-049434 filed Mar. 5, 2010. The entire content of the priority applications is incorporated herein by reference.

TECHNICAL FIELD

The present invention relates to an image forming apparatus, such as a laser printer.

BACKGROUND

Typically, tandem color printers include four photosensitive drums for yellow, magenta, cyan, and black colors. These photosensitive drums, as a whole, can be attached to and detached from the main body casing of the color printer. This type of color printer includes a drawer frame capable of moving into and out from the main body casing. The four photosensitive drums are arranged on the drawer frame. The drawer frame is provided with four cartridge mounting portions corresponding to the respective photosensitive drums, on which toner cartridges are detachably disposed to be in one-to-one correspondence with the photosensitive drums. The toner cartridge includes a developing roller and contains toner therein. When the toner cartridge becomes empty with toner, the toner cartridge is removed from the drawer frame and replaced with a new one.

SUMMARY

Recently, manufacturers of consumable products have been required to achieve cost saving and environmental protection. To this end, in the case of running out of toner, it is desirable that a developing frame holding the developing roller is left in a drawer frame and only a toner cartridge containing the toner therein is replaced, rather than replacing a toner cartridge having a developing roller and all with a new one.

In such a system that only the toner cartridge can be replaced (toner cartridge replacing system), the toner cartridge is configured to be able to be attached to and detached from the developing frame. The toner cartridge is formed with an opening for supplying toner from the toner cartridge to the developing frame. Then, the toner cartridge is provided with a shutter for opening and closing the opening and for preventing the toner from spilling from the toner cartridge in a state that the toner cartridge is detached from the developing frame.

However, in the toner cartridge replacing system, after mounting a new toner cartridge to the developing frame, a user needs to operate the shutter to open the opening. If the user forgets this opening operation, an image forming operation cannot be performed since the toner is not supplied from the toner cartridge to the developing frame.

Especially, if a plurality of photosensitive drum is arranged on the drawer frame, it occurs frequently that the opening operation of the shutter is forgotten by the user.

It is an object of the present invention to provide an image forming apparatus capable of surely preventing the toner cartridge from being accommodated in the main body casing in a state that the opening of the toner cartridge is blocked by the shutter.

This and other objects of the present invention will be attained by an image forming apparatus including a main body casing, a holder unit, a plurality of photosensitive drums, a plurality of developing units, a plurality of toner cartridges, and an interference unit. The holder unit is configured to be movable between an accommodated position where the holder unit is accommodated in the main body casing and a pulled out position where the holder unit is pulled out from the main body casing. The plurality of photosensitive drums is configured to be held by the holder unit and juxtaposed with each other with an interval between neighboring photosensitive drums. The plurality of developing units is configured to be held by the holder unit and each corresponds to each photosensitive drum to develop the corresponding photosensitive drum. The plurality of toner cartridges is detachably attached to the holder unit when the holder unit is in the pulled out position and each corresponds to each developing unit to supply toner. Each of the toner cartridges includes a case, a shutter, a first operation portion, and a second operation portion. The case contains the toner and is formed with an opening at a position confronting the corresponding developing unit in a state that the toner cartridge is attached to the holder unit. The shutter is movable between a block position where the shutter blocks the opening and an open position where the shutter opens the opening. The first operation portion is provided on the shutter and movable between a first position and a second position. The shutter is located at the open position when the first operation portion is located at the first position. The shutter is located at the block position when the first operation portion is located at the second position. The second operation portion is provided on the shutter and movable between a third position and a fourth position. The shutter is located at the open position when the second operation portion is located at the third position. The shutter is located at the block position when the second operation portion is located at the fourth position. The interference unit is configured such that the first operation portions abut the interference unit to be displaced from the second position to the first position when the holder unit is moved from the pulled out position to the accommodated position and such that the second operation portions abut the interference unit to be displaced from the third position to the fourth position when the holder unit is moved from the accommodated position to the pulled out position.

According to another aspect, the present invention provides an image forming apparatus including: a main body casing, a holder unit, a plurality of photosensitive drums, a plurality of developing units, and a plurality of toner cartridges. The holder unit is configured to be movable between an accommodated position where the holder unit is accommodated in the main body casing and a pulled out position where the holder unit is pulled out from the main body casing. The plurality of photosensitive drums is configured to be held by the holder unit and juxtaposed with each other with an interval between neighboring photosensitive drums. The plurality of developing units is configured to be held by the holder unit and each corresponds to each photosensitive drum to develop the corresponding photosensitive drum. The plurality of toner cartridges detachably attached to the holder unit when the holder unit is in the pulled out position and each corresponds to each developing unit to supply toner. Each of the toner cartridges includes a case and a shutter. A case contains the toner and is formed with an opening at a position confronting the corresponding developing unit in a state that the toner cartridge is attached to the holder unit. The shutter is movable between a block position where the shutter blocks the opening and an open position where the shutter opens the opening. The shutter is configured to be moved from the block position to the open position as the holder unit is moved from the pulled out position to the accommodated position. The shutter is configured to be moved from the open position to the block position as the holder unit is moved from the accommodated position to the pulled out position.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, an embodiment of the present invention will be described in detail with reference to the accompanying drawings.

1. Entire Configuration of a Printer

Figure 1:
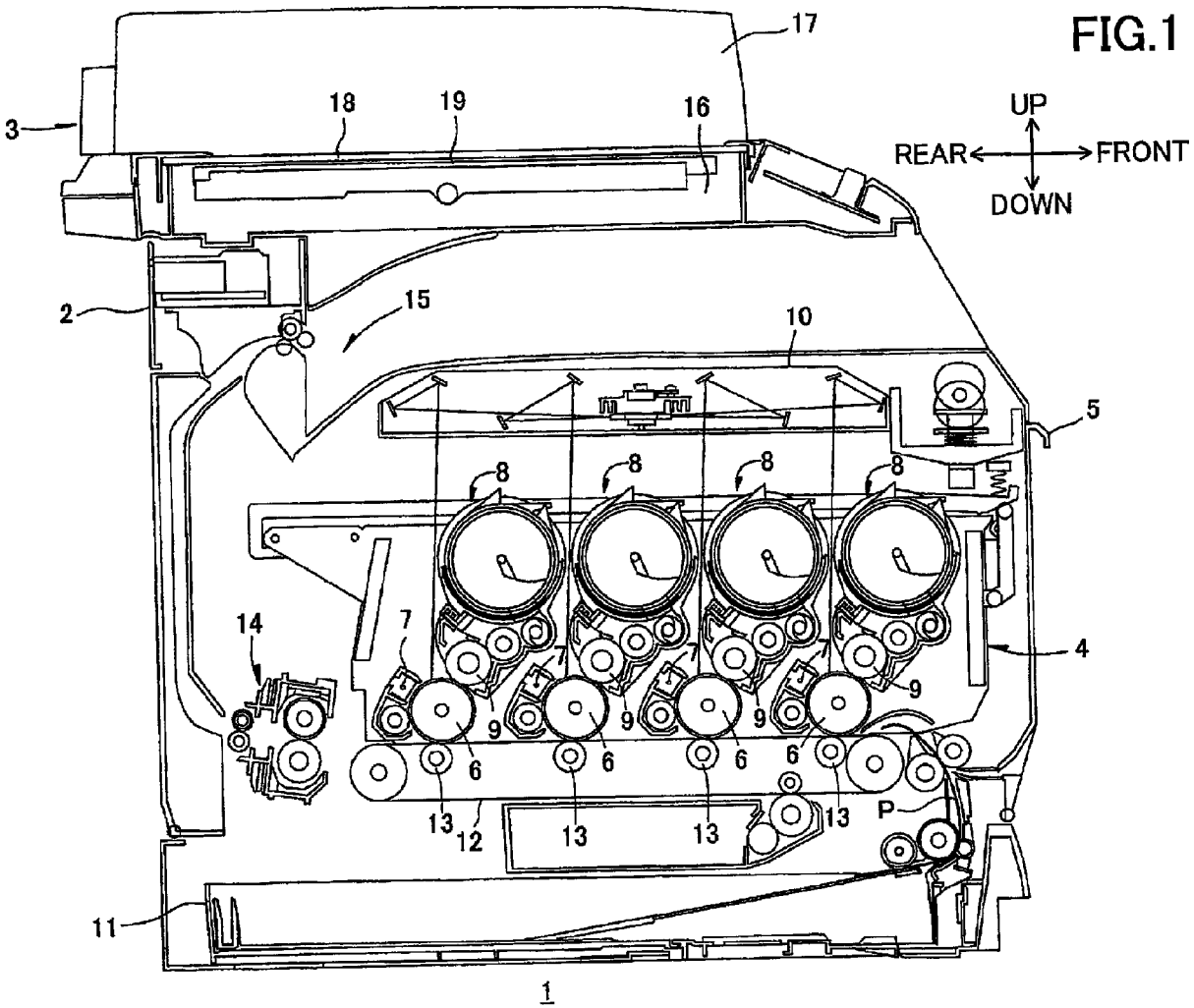
FIG. 1 is a side cross-sectional view showing a printer according to an embodiment of the present invention.

FIG. 1 is a side cross-sectional view showing a printer 1 according to an embodiment of the present invention. The printer 1 as an image forming apparatus includes a main body casing 2 formed in a box shape and a flatbed scanner 3 provided on the main body casing 2, and is a multifunction peripheral.

(1) Main Body Casing

The main body casing 2 is formed with an opening opened and closed by a front cover 5 provided at a side wall of the main body casing 2. A drum unit 4 as a holder unit is mounted on the main body casing 2. The drum unit 4 is movably mounted between a pulled out position where the drum unit 4 is pulled out from the main body casing 2 and an accommodated position where the drum unit 4 is accommodated in the main body casing 2. The terms "upward", "downward", "upper", "lower", "above", "below", "beneath" and the like will be used throughout the description assuming that the printer 1 is disposed in an orientation in which it is intended to be used. More specifically, in FIG. 1, a side of the front cover 5 (the right side in FIG. 1) will be referred to as "front side", and a side opposite to the front cover 5 will be referred to as "rear side". Further, the terms "right side" and "left side" will be used when viewed from the printer 1 from the front side.

The drum unit 4 includes four photosensitive drums 6 for the colors of black, yellow, magenta, and cyan, and arrayed in this order from the front side in the front-to-rear direction with an equal interval between neighboring photosensitive drums 6.

Further, in the drum unit 4, a scorotron charger 7 and a developer cartridge 8 as a developing unit are provided for each photosensitive drum 6. Each of developer cartridges 8 includes a developing roller 9 for supplying toner (developer) to the photosensitive drum 6. Each of the toner cartridges 8 is detachably assembled to the drum unit 4.

Above the drum unit 4, an exposure unit 10 is positioned for emitting four laser beams corresponding to the respective colors.

In accordance with the rotation of the photosensitive drum 6, the surface of the photosensitive drum 6 is uniformly charged by electrical charge from the scorotron charger 7. Then, the surface of the photosensitive drum 6 is selectively exposed by the laser beam from the exposure unit 10. Upon exposure, electrical charge on the surface of the photosensitive drum 6 is selectively erased to provide an electrostatic latent image on the surface of the photosensitive drum 6. Then, the toner is supplied to the electrostatic latent image from the developing roller 9, thereby forming a toner image corresponding to the latent image on the surface of the photosensitive drum 6. Incidentally, four LED arrays can be provided for the photosensitive drums 6 instead of the exposure unit 10.

At the bottom of the main body casing 2, a sheet cassette 11 is provided for accommodating therein a stack of sheets P. A conveyer belt 12 is provided immediately below the four photosensitive drum 6. Four transfer rollers 13 are positioned in confrontation with the photosensitive drums 6 interposing the conveyer belt 12 therebetween. A sheet P accommodated in the sheet cassette 11 is conveyed onto the conveyer belt 12 through feed rollers and the sheet P on the conveyer belt 12 is moved past the respective photosensitive drum 6 because of the running of the conveyer belt 12. Therefore, each toner image on each photosensitive drum 6 is transferred onto the sheet P because of the transfer bias applied to each transfer roller 13.

A fixing unit 14 is provided at a position downstream of the conveyer belt 12 in a sheet feeding direction. The sheet P carrying the toner image is conveyed to the fixing unit 14. The toner image on the sheet P is thermally and pressurizingly fixed to the sheet P by the fixing unit 14. A discharge tray 15 is provided downstream of the fixing unit 14 in the sheet feeding direction and at an upper surface of the main body casing 2. Image fixed sheet P is discharged onto the discharge tray 15 by way of discharge rollers.

(3) Flatbed Scanner

The flatbed scanner 3 includes a document rest 16 fixed on the main body casing 2 and a holding cover 17 pivotally supported to the document rest 16 through a hinge.

The document rest 16 is formed in a rectangular plate shape in a planar view. A platen glass 18 on which a document is placed is provided on the upper surface of the document rest 16. Inside the document rest 16, a CCD sensor 19 for reading an image of the document placed on the platen glass 18 is provided below the platen glass 18.

2. Toner Cartridge

Figure 2:
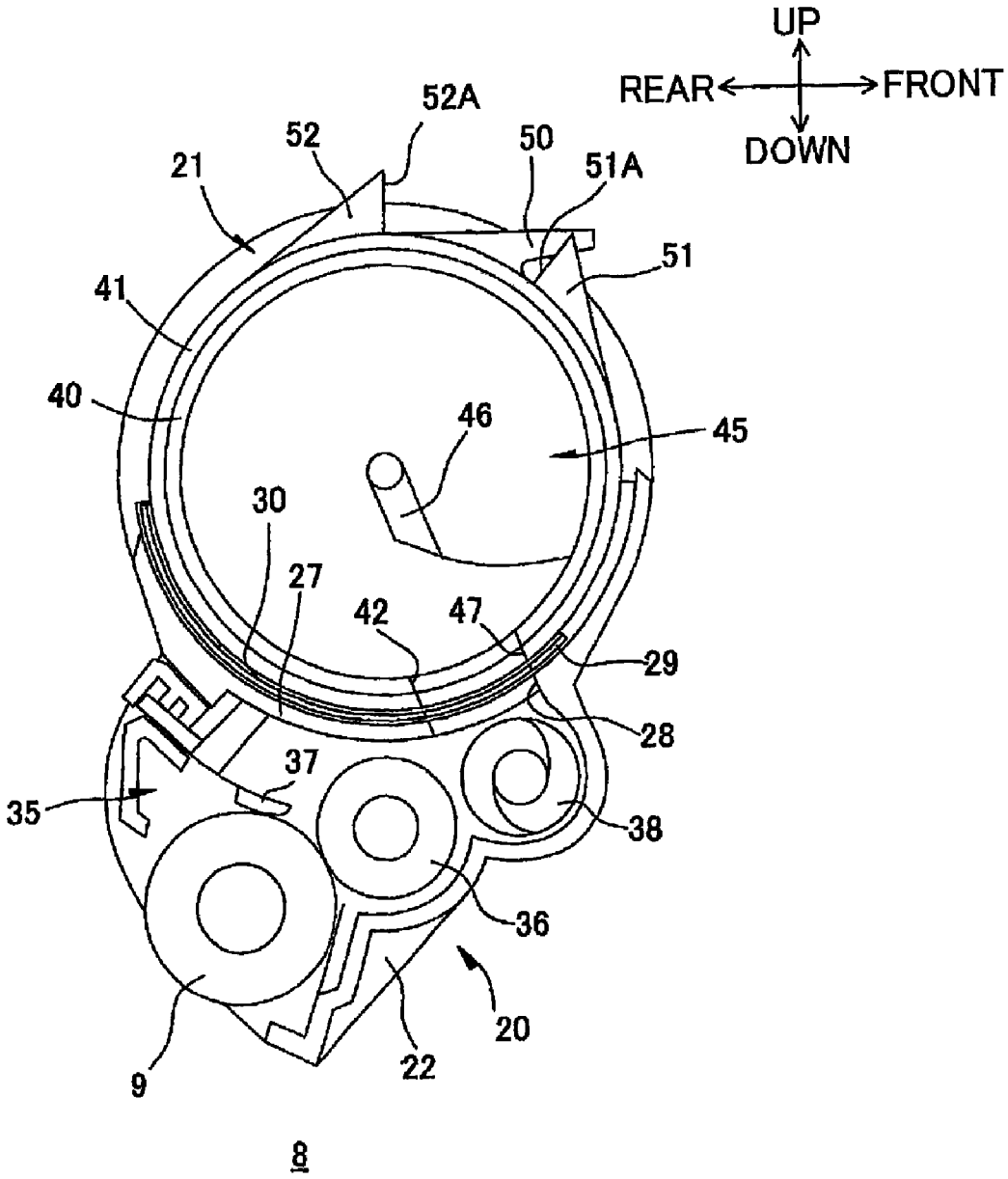
FIG. 2 is a cross-sectional view showing a toner cartridge in FIG. 1.

As shown in FIG. 2, the toner cartridge 8 includes a developing frame 20 supporting the developing roller 9 and is provided with a toner cartridge 21 detachably mounted on the developing frame 20.

(1) Developing Frame

Figure 3A:
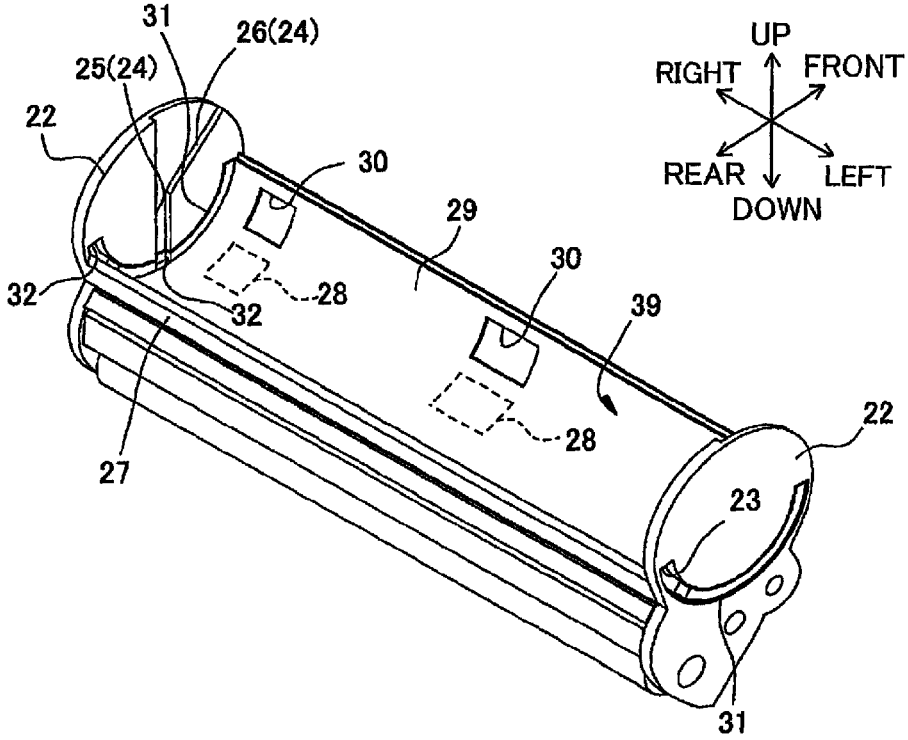
FIG. 3A is a perspective view showing a developing frame shown in FIG. 2 in which a first shutter is located at a block position.
Figure 3B:
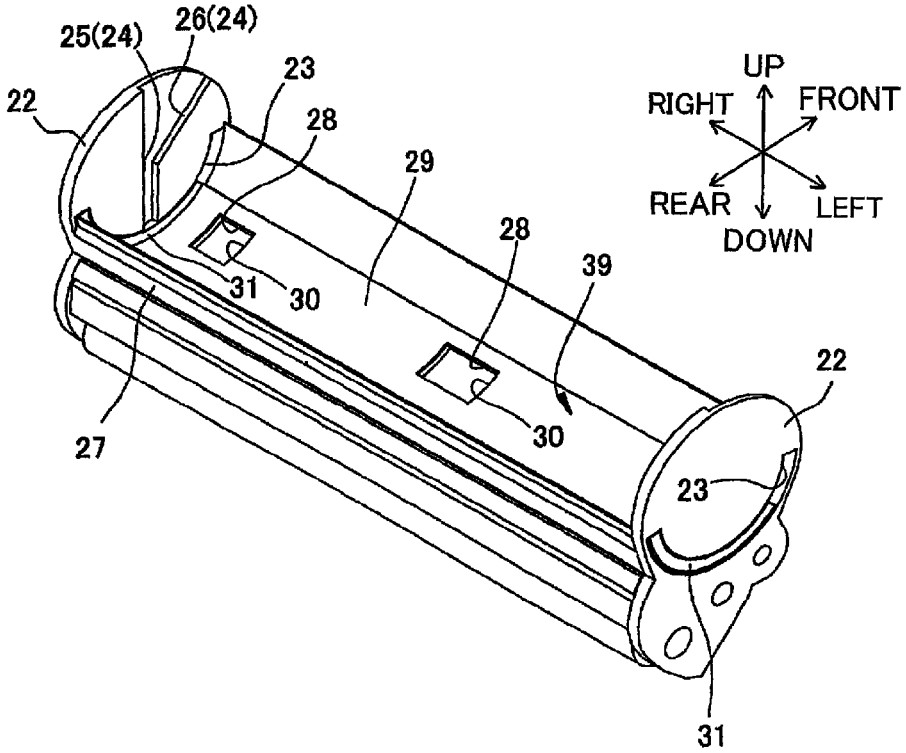
FIG. 3B is a perspective view showing the developing frame in which the first shutter is located at an open position.

As shown in FIGS. 3A and 3B, the developing frame 20 includes a pair of frame side plates 22 confronting with each other with a space in the left-to-right direction and a partition plate 27 provided between the pair of frame side plates 22 and extending in left-to-right direction. The partition plate 27 has a circular arc shape in a lateral view so as to be convex downward. The partition plate 27 is positioned at a substantially central region of the frame side plates 22 in the vertical direction. A region between the pair of frame side plates 22 is divided into upper side and lower side regions by the partition plate 27. In the lower side region, a developing chamber 35 on which the developing roller 9 is positioned (see FIG. 2) is formed. In the upper side region, a cartridge mounting region 39 on which the toner cartridge 21 is detachably mounted is defined.

Each of the frame side plate 22 is formed with a slide guide portion 23 as a regulating member. Each of the slide guide portion 23 extends along the partition plate 27 and penetrates the corresponding frame side plate 22 in the left-to-right direction (the thickness direction of the frame side plate 22).

Further, each of the frame side plate 22 is formed with a mounting guide portion 24 extending upward from a center of the side guide member 23 in a circumferential direction of the partition plate 27. The mounting guide portion 24 has a groove shape formed by depressing the inner surface of the frame side plate 22. The mounting guide portion 24 has an extending portion 25 extending upward from the slide guide portion 23 with a fixed width and a guide portion 26 connected to an upper end of the extending portion 25 and having a fan shape spreading upward and frontward from the upper end of the extending portion 25.

As indicated by a dashed line in FIG. 3A, the partition plate 27 is formed with three first communication openings 28 each having rectangular shape at positions displaced from the center of the partition plate 27 in the circumferential direction thereof toward the rear side. The first communication openings 28 are arrayed in the left-to-right direction with an interval between neighboring first communication openings 28. Note that, FIGS. 3A and 3B show only two of three first communication openings 28.

Further, a first shutter 29 is provided between the pair of frame side plates 22 at the upper side region of the partition plate 27. The first shutter 29 has a circular arc shape and extends along the inner surface of the partition plate 27.

The first shutter 29 has a length in the circumferential direction smaller than that of the partition plate 27 and a width in the left-to-right direction substantially the same as that of the partition plate 27. At both ends of the first shutter 29 in the left-to-right direction, ribs 31 are provided throughout an entire region of the first shutter 29 in the circumferential direction of the partition plate 27. Each of the ribs 31 radially and inwardly protrudes from the first shutter 29 and is positioned inside the slide guide portion 23 formed at the frame side plate 22. Hence, the first shutter 29 is slidably supported by the pair of frame side plates 22 in the circumferential direction of the partition plate 27. Further, as shown in FIG. 3A, the rib 31 is formed with a notched portion 32.

The first shutter 29 is formed with three first shutter openings 30 each having substantially the same shape as the first communication openings 28. The first shutter openings 30 are located at positions corresponding to the first communication openings 28 in the left-to-right direction. As shown in FIG. 3A, when the front end part of the first shutter 29 is in confrontation with the front end part of the partition plate 27 in a radial direction of the partition plate 27, the respective first shutter openings 30 are located at a position anterior to the first communication openings 28. In this state, the first shutter 29 is positioned at a block position where the first shutter 29 blocks the first communication openings 28. Further, as shown in FIG. 3B, when the rear end part of the first shutter 29 is in confrontation with the rear end part of the partition plate 27 in the radial direction of the partition plate 27, each of the first shutter openings 30 communicates with the corresponding first communication opening 28. In this state, the first shutter 29 is positioned at an open position where the first shutter 29 opens the first communication openings 28.

As shown in FIG. 3A, when the first shutter 29 is located at the block position, the notched portion 32 is in confrontation with the extending portion 25 so as to be in communication with the extending portion 25.

As shown in FIG. 2, in the developing chamber 35, the developing roller 9, a supply roller 36, a layer thickness regulating blade 37, and a screw auger 38 are provided.

The developing roller 9 extends in the left-to-right direction and is rotatably supported by the developing frame 20. A part of the outer circumferential surface of the developing roller 9 is exposed from the developing frame 20 to rearward and downward. When the toner cartridge 8 is assembled to the drum unit 4 (see FIG. 1), a part of the developing roller 9 that is exposed from the developing frame 20 is in contact with the outer circumferential surface of the photosensitive drums 6.

The supply roller 36 extends in the left-to-right direction and is rotatably supported by the developing frame 20. The supply roller 36 is positioned at the lower rear side of the first communication openings 28 and is in pressed contact with the developing roller 9 from the upper front side thereof.

The layer thickness regulating blade 37 has a base portion and a tip portion. The base portion of the layer thickness regulating blade 37 is fixed to the rear side portion of the developing frame 20. The tip portion of the layer thickness regulating blade 37 contacts with the outer circumferential surface of the developing roller 9 with pressure.

The screw auger 38 extends in the left-to-right direction, is positioned at the lower side of the first communication openings 28, and is rotatably supported on the developing frame 20.

When the toner cartridge 8 is mounted on the main body casing 2, the developing roller 9, the supply roller 36, and the screw auger 38 are arrayed substantially on one straight line, and the first communication openings 28 are positioned above the screw auger 38.

(2) Toner Cartridge

Figure 4A:
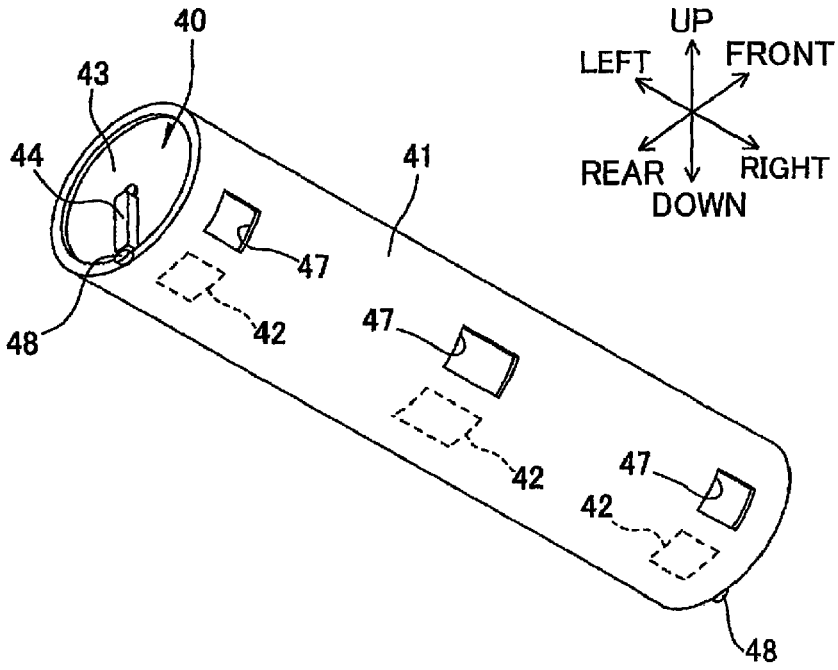
FIG. 4A is a perspective view showing a toner cartridge shown in FIG. 2 in which a second shutter is located at a block position.
Figure 4B:
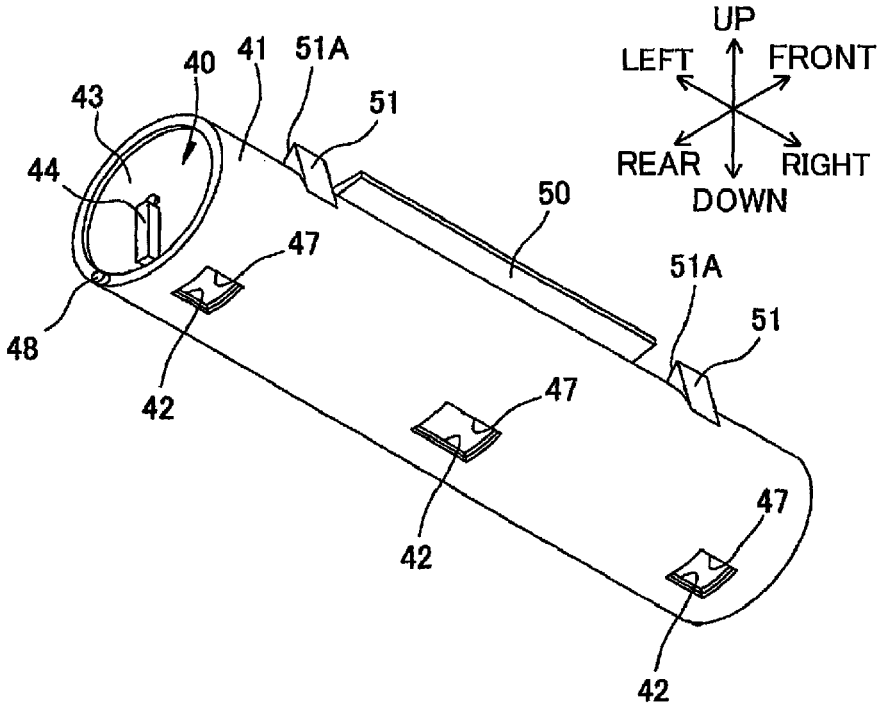
FIG. 4B is a perspective view showing the toner cartridge in which the second shutter is located at an open position.

As shown in FIGS. 4A and 4B, the toner cartridge 21 includes a main body portion 40 as a case and a second shutter 41 as a shutter accommodating the main body portion 40 therein. Each of the main body portion 40 and the second shutter 41 has a cylindrical shape. The main body portion 40 has an outer diameter slightly smaller than the inner diameter of the second shutter 41. Hence, the main body portion 40 is surrounded by the second shutter 41.

As indicated by a dashed line in FIG. 4A, the main body portion 40 is formed with three second communication openings 42 as an opening each having rectangular shape. The second communication openings 42 are arrayed in the left-to-right direction with an interval between neighboring first communication openings 28 (an axial direction of the main body portion 40). Each of the second communication openings 42 is formed at substantially the same size as the first communication opening 28 (see FIG. 3A).

Both ends of the main body portion 40 in the left-to-right direction are sealed by disk-shaped sealing plates 43. A regulating protrusion 44 is provided on the outer surface of the sealing plate 43. The regulating protrusion 44 outwardly projects from the sealing plate 43. The regulating protrusion 44 extends from the center of the sealing plate 43 in a radial direction of main body portion 40 and is formed throughout the entire length of the radius of the sealing plate 43. Further, the regulating protrusion 44 has substantially the same width as the extending part 25 (see FIG. 3A) of the mounting guide part 24.

As shown in FIG. 2, the inner space of the main body portion 40 defines a containing chamber 45 containing the toner. An agitator 46 for agitating the toner is provided in the containing chamber 45.

The agitator 46 is located on the vertical line right above the supply roller 36, and the developing chamber 35 is arranged with the toner cartridge 21 in the vertical direction.

The second shutter 41 is provided so as to move slidably with respect to the main body portion 40 in the circumferential direction thereof. The second shutter 41 is formed with three second shutter openings 47 each having substantially the same shape as the second communication openings 42. The second shutter openings 47 are located at positions corresponding to the second communication openings 42 in the left-to-right direction.

Figure 5:
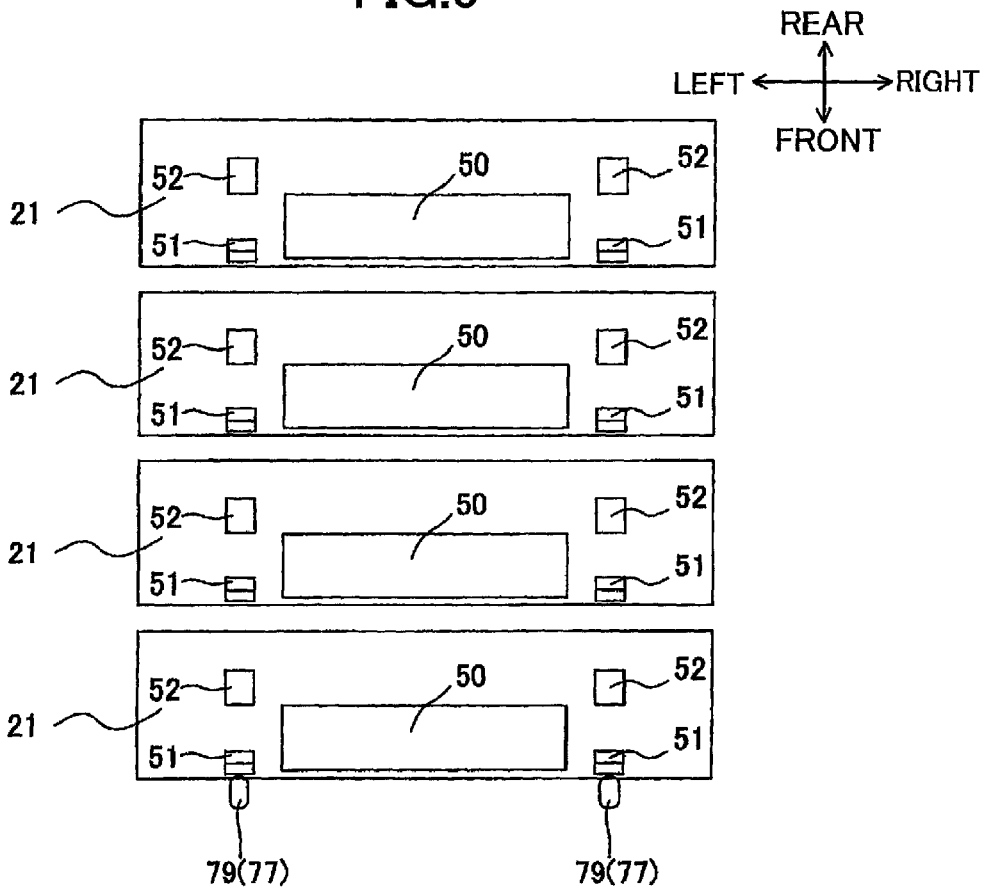
FIG. 5 is a schematic plan view showing the toner cartridges mounted on a drum unit according to the present embodiment.

Further, a grip portion 50 is provided on the second shutter 41 at a side opposite to the second shutter openings 47 with respect to the central axis of the second shutter 41. That is, the central axis of the second shutter 41 is positioned between the grip portion 50 and the second shutter openings 47. As shown in FIGS. 4B and 5, the grip portion 50 has a plate shape protruding from a central region of the second shutter 41 in the left-to-right direction in a tangential direction thereof in a state that the toner cartridge 21 is mounted on the developing frame 20.

A pair of first operation portions 51 and a pair of second operation portions 52 are provided on the outer circumferential surface of the second shutter 41.

The pair of first operation portions 51 are provided at both side of the grip portion 50 in the left-to-right direction and located at substantially the same position as the front end portion of the grip portion 50 in a circumferential direction of the second shutter 41. As shown in FIG. 2, each of the first operation portions 51 is formed in a triangle shape projecting from the second shutter 41. A rear side surface of each first operation portion 51 defines a first abutting surface 51A capable of abutting an interference unit 77 described later.

The pair of second operation portions 52 are provided at both side of the grip portion 50 in the left-to-right direction and located at a position opposite to the position located at the first operation portions 51 with respect to the grip portion 50 in the circumferential direction. As shown in FIG. 2, each of the second operation portions 52 is formed in a triangle shape projecting from the second shutter 41. A rear side surface of each second operation portion 52 defines a second abutting surface 52A capable of abutting the interference unit 77 described later.

As shown in FIG. 5, the first operation portions 51 and the second operation portions 52 of each toner cartridge 21 are positioned to be in confrontation with each other in the front-to-rear direction. Further, the first operation portions 51 and the second operation portions 52 of all of the toner cartridges 21 are positioned to be in confrontation with each other in the front-to-rear direction when four toner cartridges 21 are juxtaposed with each other. As shown in FIG. 2, the positions and the shapes of the first operation portion 51 and the second operation portion 52 are symmetrical to a plane including a central axis of the main body portion 40 and a middle point of a line segment that connects the first operation portion 51 and the second operation portion 52 with a shortest distance.

As shown in FIG. 4A, a pair of engaging protrusions 48 is provided at both ends of the second shutter 41 in the left-to-right direction. Each of the engaging protrusion 48 is in confrontation with the outside (the side opposite to the center side) end part of the regulating protrusion 44 in the radial direction of the main body portion 40 and outwardly projects from the both ends of the second shutter 41. The engaging protrusion 48 has substantially the same size (width) as the notched portion 32 (see FIG. 3A) of the first shutter 29. In this state, the second shutter openings 47 are located at positions displaced from the second communication openings 42 in the circumferential direction of the main body portion 40. In other words, the second shutter openings 47 is not in confrontation with the second communication openings 42 in the radial direction of the main body portion 40. In this state, the second shutter 41 is positioned at a block position where the second shutter 41 blocks the second communication openings 42.

Further, as shown in FIG. 4B, when the engaging protrusion 48 is located at a position displaced from the regulating protrusion 44 in the circumferential direction of the main body portion 40, the second shutter openings 47 are located at positions in confrontation with the second communication openings 42 in the radial direction of the main body portion 40. In this state, the second shutter 41 is positioned at an open position where the second shutter 41 opens the second communication openings 42.

A sealing member (not shown) for preventing the toner from spilling at the periphery of the second communication openings 42 and the second shutter openings 47 is inserted between the main body portion 40 and the second shutter 41 in a compressed state. The sealing member has, for example, a known configuration such as a sponge.

3. Drum Unit

Figure 6:
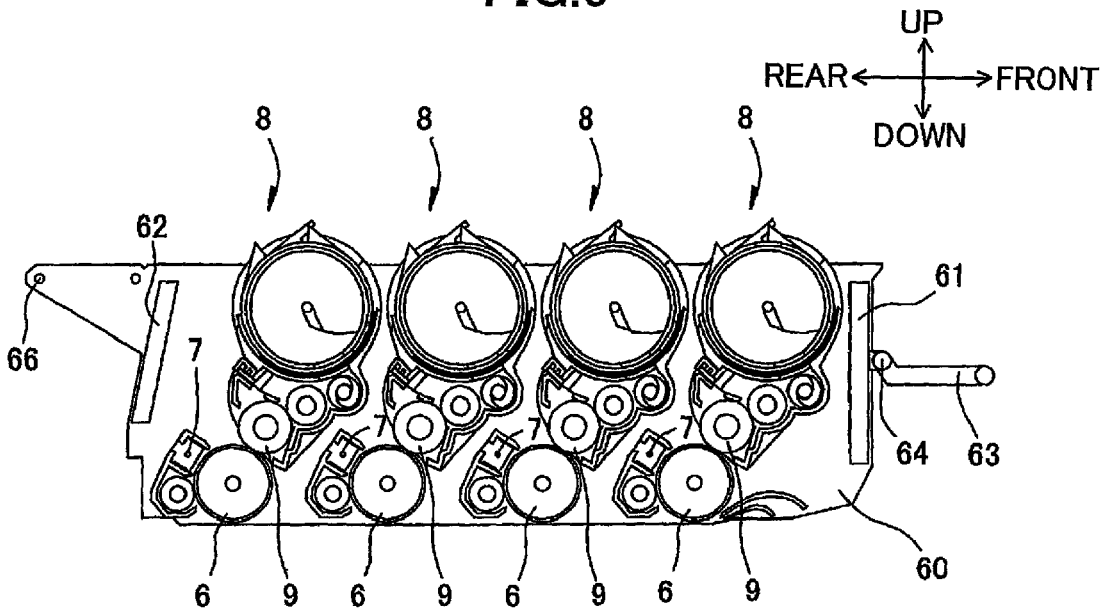
FIG. 6 is a cross-sectional view showing the drum unit shown in FIG. 1.

As shown in FIG. 6, the drum unit 4 includes a pair of drum side plates 60, a front beam 61, and a rear beam 62. The pair of drum side plates 60 is in confrontation with each other with a space in the left-to-right direction. The front beam 61 extends in the left-to-right direction and connects the front end portion of one drum side plate 60 to the front end portion of another drum side plate 60. The rear beam 62 extends in the left-to-right direction and connects the rear end portion of one drum side plate 60 to the rear end portion of another drum side plate 60.

Each of the drum side plate 60 is formed in a plate shape extending in the front-to-rear direction and the vertical direction, and collectively supports the four photosensitive drums 6 and the scorotron chargers 7. Further, flange portions (not shown) are provided at the upper end portions of the drum side plates 60, respectively. Each of the flange portions extends in the front-to-rear direction and projects laterally outwardly from the drum side plate 60. A roller (not shown) rotatable about a shaft extending laterally is provided at the rear end portion of the flange portion.

As shown in FIG. 5, a drum hand grip 63 is provided on the front beam 61. The drum hand grip 63 is pivotally provided about a pivot shaft 64 provided at the front beam 61 between a proximity position (see FIG. 1) proximal to the front beam 61 and a separate position separated from the front beam 61. When the drum hand grip 63 is in the separate position, the drum hand grip 63 can be gripped so as to slide the drum unit 4 with respect to the main body casing 2 (see FIG. 1).

4. Configuration of Main Body Casing

Figure 7:
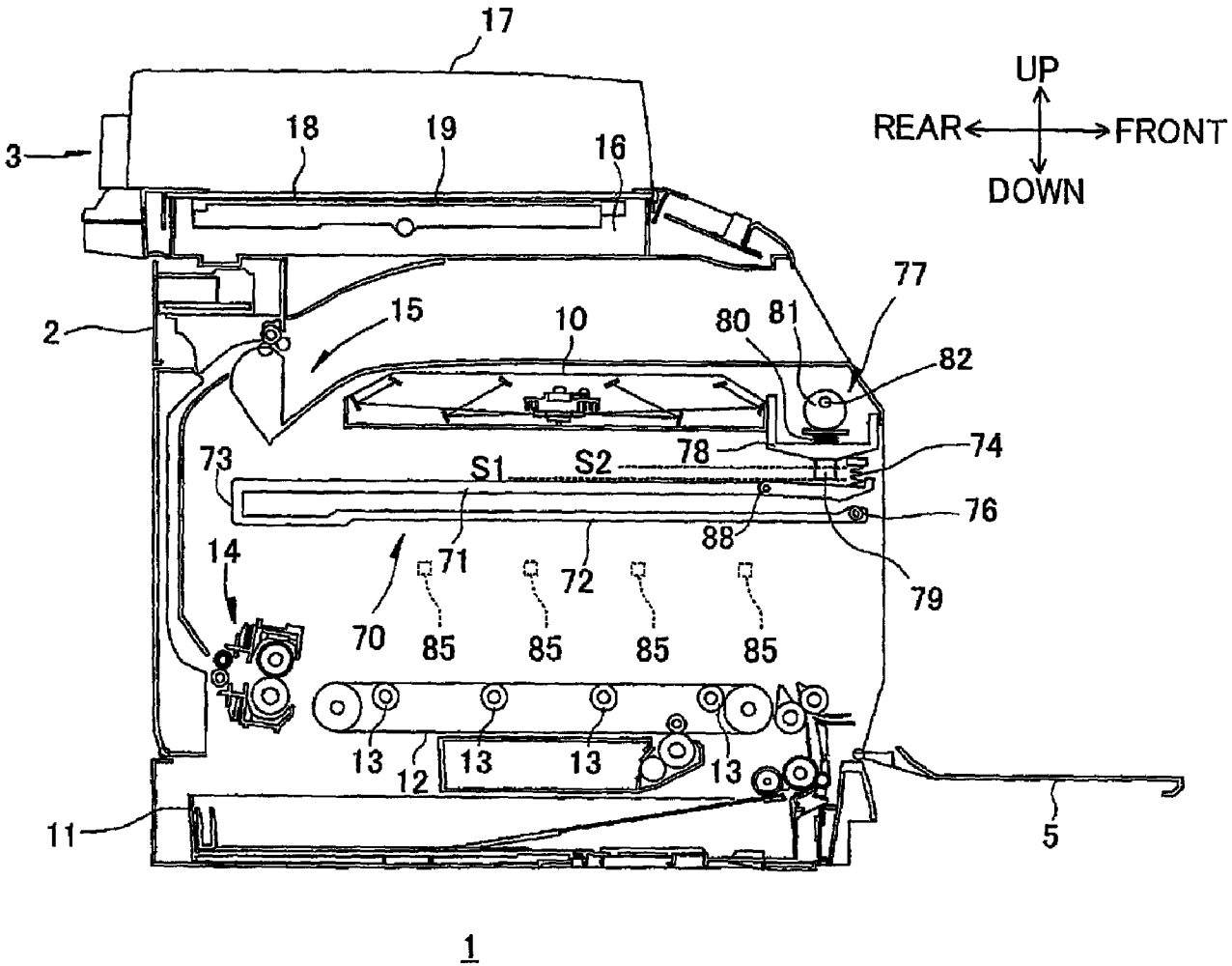
FIG. 7 is a cross-sectional view showing the printer in a state that the drum unit is detached from a main body casing.

As shown in FIG. 7, the main body casing 2 is provided with a pair of rails 70 extending in the front-to-rear direction and each provided at each side wall of the main body casing 2. When the drum unit 4 is located at the accommodated position (see FIG. 1), each of the rails 70 is in confrontation with the flange portion (not shown) provided on the drum side plate 60 (see FIG. 6) in the left-to-right direction.

The rail 70 is integrally provided with an upper side portion 71, a lower side portion 72, and a rear side portion 73.

The upper side portion 71 extends in the front-to-rear direction. The upper side portion 71 serves as a second supporting portion for supporting the drum unit 4 when the drum unit 4 is pulled out from and accommodated in the main body casing 2. At the front end portion of the upper side portion 71, a swing portion 75 is attached through a swing shaft 88 extending in the left-to-right direction. The swing portion 75 extends from the front end portion of the upper side portion 71 toward the front side thereof. Further, an urging member 74 is attached to the front end portion of the swing portion 75. This urging member 74 urges the front end portion of the swing portion 75 downward.

The lower side portion 72 is in confrontation with the upper side portion 71 and the swing portion 75 from below throughout the front-to-rear direction. The lower side portion 72 includes a front section, an intermediate section, and a rear section. The rear section of the lower side portion 72 is lowered by one step from the intermediate section of the lower side portion 72 so as to form a crank shape. Further, the front section of the lower side portion 72 is raised by one step from the intermediate section of the lower section. A roller 76 as a first supporting portion is attached to the front section of the lower side portion 72.

The rear side portion 73 extends in the vertical direction and connects the rear end portion of the upper side portion 71 and the rear end portion of the lower side portion 72.

Further, at a position slightly rearward of the roller member 76, the interference unit 77 is provided above the swing portion 75. The main body casing 2 is provided with a pair of the interference units 77 each provided at each side wall of the main body casing 2. The pair of interference units 77 is disposed at the front side of the exposure unit 10 and a portion of each interference unit 77 is in confrontation with the exposure unit 10 in the front-to-rear direction. As shown in FIG. 5, the interference unit 77 is in confrontation with the first operation portion 51 and the second operation portion 52 of each toner cartridge 21 in the front-to-rear direction.

The interference unit 77 includes a supporting portion 78, an abutting portion 79, an urging portion 80, and a cam portion 81.

The supporting portion 78 has a top opened U-shaped configuration in side view and fixedly provided on the main body casing 2. The abutting portion 79 has a columnar shape penetrating the lower section of the supporting portion 78 in the vertical direction. The urging portion 80 is a coil spring interposed between the supporting portion 78 and the upper portion of the abutting portion 79 and constantly urges the abutting portion 79 upward. The cam portion 81 is an eccentric cam and supported on the main body casing 2 through a cam shaft 82 to abut against the upper end portion of the abutting portion 79.

The main body casing 2 is provided with four pairs of sensors 85 as a detecting unit, each corresponding to each toner cartridge 21. When the drum unit 4 is located at the accommodated position, each pair of the sensors 85 is in confrontation with the corresponding toner cartridge 21 in the left-to-right direction. Each pair of sensors 85 includes a pair of photosensors in confrontation with each other with a space in the left-to-right direction. That is, one of the pair of photosensors is provided on one side wall of the main body casing 2 in the left-to-right direction and the other of the pair of photosensors is provided on the other side wall of the main body casing 2 in the left-to-right direction so as to face one of the pair of photosensors. Detection light emitted from one of the pair of photosensors passes through a detection window (not shown) formed on the toner cartridge 21 (frame side plates 22) to enter the other of the pair of photosensors. Each of the pairs of the sensors 85 detects a toner amount contained in the corresponding toner cartridges 21. The cam portion 81 is driven based on the detected toner amount.

Specifically, when the toner amount in the toner cartridge 21 is less than a predetermined amount, it is determined that the toner cartridge 21 needs to be replaced. According to the determination, the cam part 81 is driven to press the abutting portion 79 downward. Hence, the abutting portion 79 moves downward against an urging force of the urging portion 80 so as to locate the lower end portion of the abutting portion 79 at an abutting position. The abutting position is positioned between a first reference surface S1 as a reference surface and a second reference surface S2. The first and second reference surfaces S1, S2 are horizontal planes extending in the front-to-rear direction and the left-to-right direction. In other words, the first and second reference surfaces S1, S2 are perpendicular to the vertical direction. The first reference surface S1 is positioned below the second reference surface S2 in the vertical direction.

On the other hand, when the toner amount in the toner cartridge 21 is equal to or greater than the predetermined amount, it is determined that the toner cartridge 21 does not need to be replaced. According to the determination, the cam part 81 is driven to move the abutting portion 79 upward. Hence, the abutting portion 79 moves upward by the urging force of the urging portion 80 so as to locate the lower end portion of the abutting portion 79 at a retreat position above the second reference surface S2.

5. Operations for Mounting Toner Cartridge onto Developing Frame

The toner cartridge 21 is mounted on the developing frame 20 in a state that the drum unit 4 is in the pulled out position where the drum unit 4 is pulled out from the main body casing 2.

Figure 8:
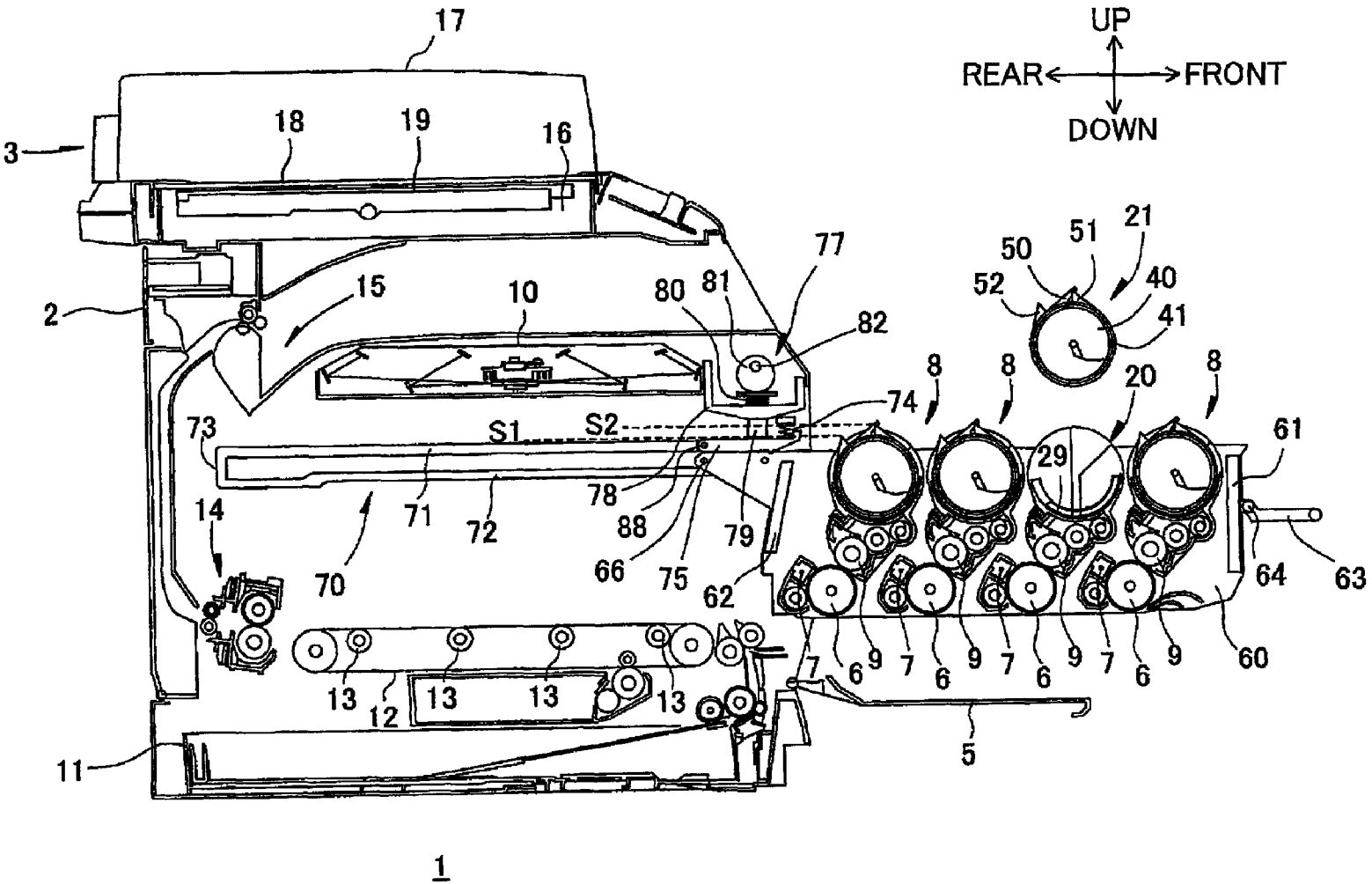
FIG. 8 is a side cross-sectional view showing the printer in a state that one toner cartridge is detached from the developing frame.

As shown in FIG. 8, the toner cartridge 21 is positioned above the developing frame 20. In this state, the first shutter 29 of the developing frame 20 is located at the block position shown in FIG. 3A. The second shutter 41 of the toner cartridge 21 is also located at the block position shown in FIG. 4A. Further, the regulating protrusion 44 is aligned with the engaging protrusion 48 in the radial direction of the main body portion 40.

Then, the toner cartridge 21 is moved toward the cartridge mounting region 39. The regulating protrusion 44 and the engaging protrusion 48 are guided along the mounting guide portion 24 downward, the regulating protrusion 44 enters the extending portion 25 of the mounting guide portion 24, and the engaging protrusion 48 enters the notched portion 32 of the first shutter 29. Thereby, while the first shutter 29 is interlocked with the second shutter 41, movement of the main body portion 40 of the toner cartridge 21 in the circumferential direction is regulated by the extending portion 25. In this state, the grip portion 50 stands with respect to the developing frame 20 and the tip portion of the grip portion 50 is separated away from the developing frame 20.

Further, in this state, each of the first operation portions 51 is located at a second position where the first operation portion 51 is positioned between the first reference surface S1 and the second reference surface S2 in the vertical direction. The second position corresponds to the abutting position. Each of the second operation portions 52 is located at a fourth position where the second operation portion 52 is positioned below the first reference surface S1 in the vertical direction.

6. Operations for Accommodating Drum Unit in Main Body Casing

As shown in FIG. 8, operations for accommodating the drum unit 4 in the main body casing 2 are performed in a state that the front cover 5 is opened.

When the drum unit 4 is located at the pulled out position, the rear end portion of the flange portion (not shown) of the drum side plate 60 is positioned at the front end portion of the rail 70. In this state, the rear end portion of the flange portion abuts the upper side portion 71 of the rail 70 from below. In other words, a part of the upper side portion 71 that abuts the roller (not shown) provided at the rear end portion of the flange portion holds the drum unit 4. Further, a midway portion of the flange portion abuts the roller 76 provided at the lower side portion 72 of the rail 70 (see FIG. 7) from above. As shown in FIG. 6, the swing portion 75 is urged downward by the urging member 74. Therefore, the midway portion of the flange portion is pressed downward through the swing portion 75.

Figure 9:
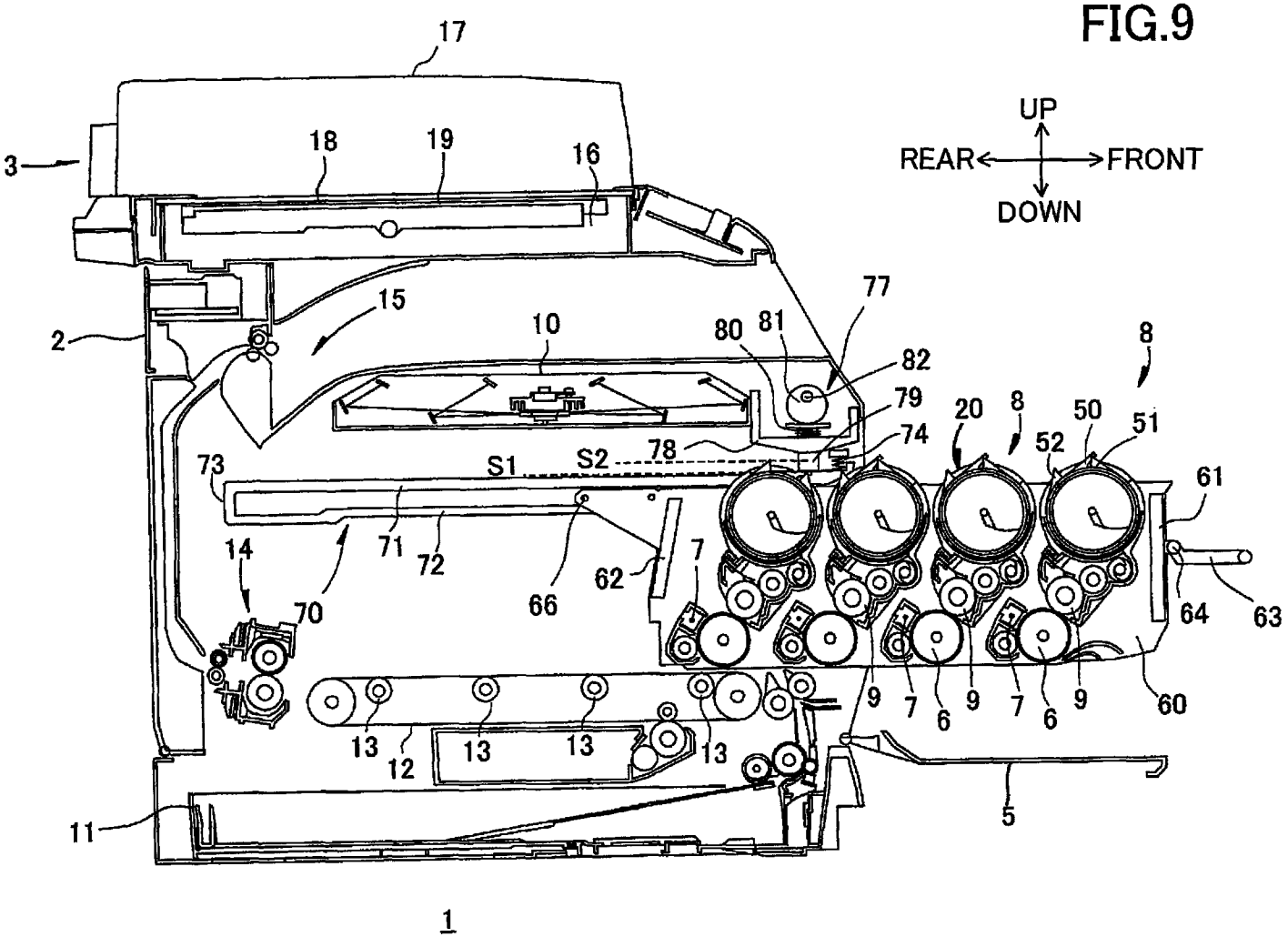
FIG. 9 is a side cross-sectional view showing a state of the drum unit on the way to an accommodated position from a pulled out position.

Then, by moving the drum unit 4 backward, as shown in FIG. 9, the first abutting surfaces 51A of the first operation portions 51 located at the second position abut the abutting portions 79 of the interference members 77 from the front side. After that, the drum unit 4 is moved further backward, and then, a force is applied to the first operation portions 51 from the abutting portions 79. Therefore, the tip ends of the first operation portions 51 are moved frontward to displace from the second position to a first position where the first operation portions 51 are positioned below the first reference surface S1.

At this time, in conjunction with the first operation portions 51, the second operation portions 52 are displaced from the fourth position below the first reference surface S1 to a third position where the second operation portions 52 are positioned between the first reference surface S1 and the second reference surface S2. Then, the second shutter 41 is moved from the block position to the open position. As shown in FIG. 3A through 4B, since the second shutter 41 is connected to the first shutter 29 through the engaging protrusions 48 and the notched portions 32, the first shutter 41 also moves from the block position to the open position with the movement of the second shutter 41 to the open position. At this time, the ribs 31 of the first shutter 29 move along the slide guide portions 23, respectively.

After that, the first shutter 29 and the second shutter 41 are located at the open position. Then, as shown in FIG. 2, while the first communication openings 28 are in confrontation with the first shutter openings 30, the second communication openings 42 are in confrontation with the second shutter openings 47. As a result, the containing chamber 45 of the toner cartridge 21 communicates with the developing chamber 35 in the developing frame 20 through the second communication openings 42, the second shutter openings 47, the first shutter openings 30, and the first communication openings 28. In this state, the toner in the main body portion 40 can be supplied to the developing chamber 35 through the openings 42, 47, 30, and 28.

Subsequently, when the rear end part of the flange portion (the drum side plate 60) abuts the rear side portion 73 of the rail 70 by further moving the drum unit 4 rearward, the rearward movement of the drum unit 4 is regulated by the rear side portion 73. Thereby, the drum unit 4 is accommodated in the main body casing 2 and is located at the accommodated position.

7. Operation and Effect

As described above, the drum unit 4 is provided so as to be movable between the accommodated position where the drum unit 4 is accommodated in the main body casing 2 and the pulled out position where the drum unit 4 is pulled out from the main body casing 2. The plurality of photosensitive drums 6 and the plurality of toner cartridges 8 are held in the drum unit 4. The plurality of photosensitive drums 6 are juxtaposed with one another with an interval between neighboring photosensitive drums 6. Each of the toner cartridges 8 is provided on the corresponding photosensitive drum 6.

When the drum unit 4 is in the pulled out position, the toner cartridge 21 is detachably mounted on the developing frame 20. The second communication openings 42 for supplying the toner in the main body portion 40 to the developing roller 9 is formed on the main body portion 40 at a position confronting the first communication openings 28 of the developing frame 20 in a state that the toner cartridge 21 is mounted on developing frame 20. Further, the toner cartridge 21 is provided with the second shutter 41. The second shutter 41 is provided so as to be movable between the open position where the second shutter 41 opens the second communication openings 42 through the second shutter openings 47 and the block position where the second shutter 41 blocks the second communication openings 42.

The second shutter 41 is provided with the first operation portions 51 and the second operation portions 52. When the second shutter 41 is located at the open position, the first operation portion 51 is located at the first position and the second operation portion 52 is located at the third position. When the second shutter 41 is located at the block position, the first operation portion 51 is located at the second position and the second operation portion 52 is located at the fourth position.

The main body casing 2 is provided with the interference units 77. When the drum unit 4 is moved from the pulled out position to the accommodated position, the interference units 77 abut the first abutting surfaces 51A of the first operation portions 51 to displace the first operation portions 51 from the second position to the first position with the movement of the drum unit 4 after the abutting shown in FIG. 9. At this time, the second operation portions 52 are also displaced from the fourth position to the third position.

Therefore, even if the drum unit 4 is moved from the pulled out position to the accommodated position in a state that the second communication openings 42 are blocked by the second shutter 41, the first operation portions 51 are displaced from the second position to the first position. Therefore, after the toner cartridge 21 having the second communication openings 42 blocked by the second shutter 41 is mounted on the drum unit 4, even if a user does not operate the first operation portions 51 to displace from the second position to the first position (i.e. the user does not operate the first operation portions 51 to open the second shutter 41), the second shutter 41 is moved from the block position to the open position by the interference units 77. Accordingly, the toner cartridge 21 can be certainly prevented from being accommodated in the main body casing 2 in a state that the second communication openings 42 is blocked by the second shutter 41.

Figure 10:
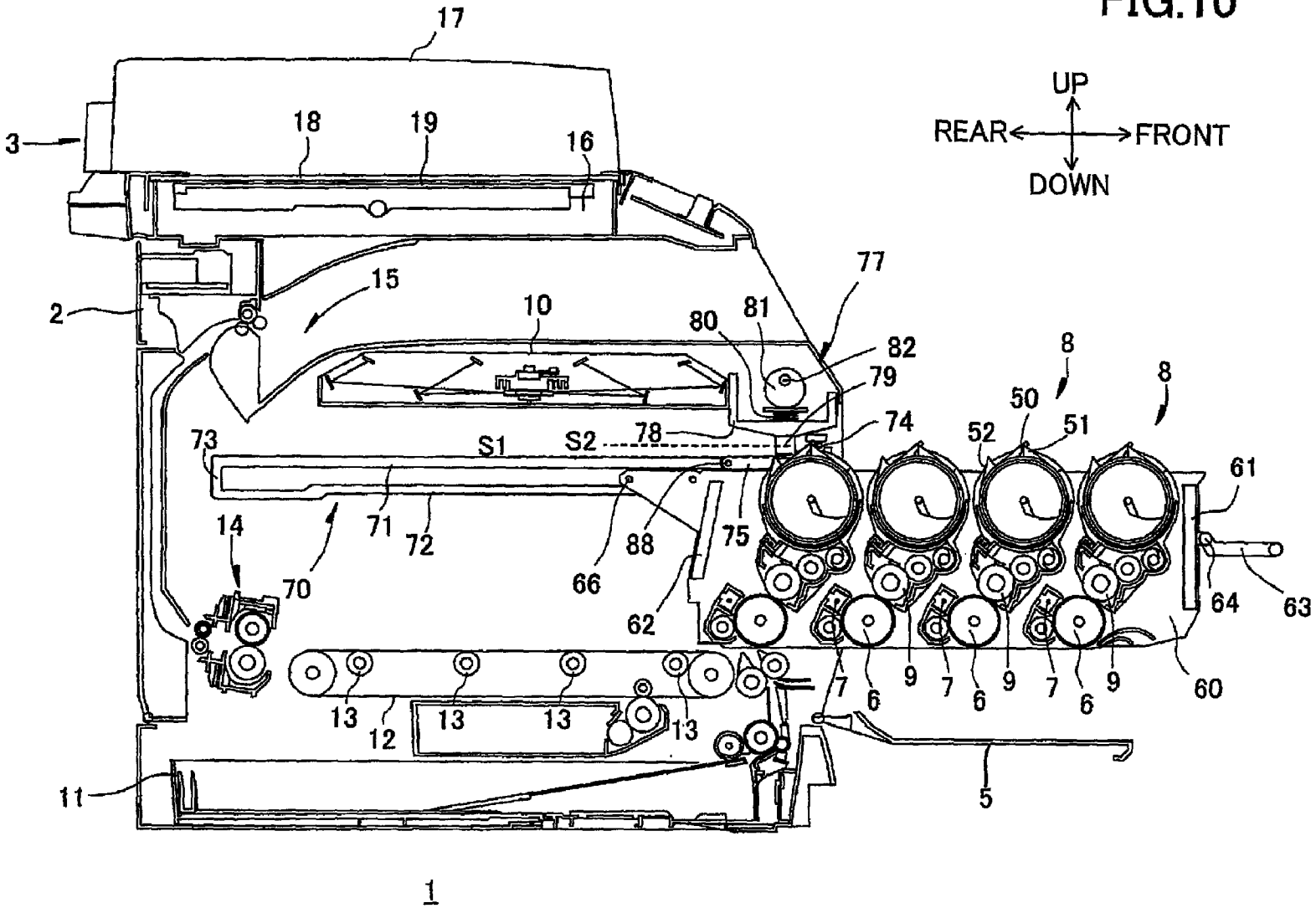
FIG. 10 is a side cross-sectional view showing a state of the drum unit on the way to the pulled out position from the accommodated position.

Further, when the drum unit 4 is moved from the accommodated position to the pulled out position, the interference units 77 abut the second abutting surfaces 52A of the second operation portions 52 to displace the second operation portions 52 from the third position to the fourth position with the movement of the drum unit 4 after the abutting shown in FIG. 10. Hence, the second shutter 41 is moved from the open position to the block position. Therefore, even if the toner cartridge 21 is detached from the developing frame 20 immediately after the drum unit 4 is pulled out from the main body casing 2, the toner can be prevented from spilling from the toner cartridge 21 through the second communication openings 42 since the second communication openings 42 of the toner cartridge 21 are blocked by the second shutter 41.

Each first operation portion 51 and the corresponding second operation portion 52 of each toner cartridge 21 are aligned in the front-to-rear direction. In other words, each first operation portion 51 and the corresponding second operating part 52 are located at a same position in the left-to-right direction. Therefore, when the drum unit 4 is moved from the pulled out position to the accommodated position, the interference units 77 can abut the first operation portions 51 certainly. Further, when the drum unit 4 is moved from the accommodated position to the pulled out position, the interference units 77 can abut the second operation portions 52 certainly. Accordingly, in comparison with a configuration in which each first operation portion 51 and the corresponding second operation portion 52 of each toner cartridge 21 are located at different positions in the left-to-right direction, the single interference unit 77 can be used for each first operation portion 51 and the corresponding second operation portion 52, and the size of the interference member 77 in the left-to-right direction can be reduced.

Two first operation portions 51 are provided on each toner cartridges 21 with an interval in the left-to-right direction. In other words, the first operation portions 51 are disposed apart form each other in the axial direction of the main body portion 40. Hence, when the drum unit 4 moves from the pulled out position to the accommodated position, a force can be applied from the interference units 77 to the first operation portions 51 in a balanced manner in the left-to-right direction. Therefore, the first operation portions 51 can be smoothly moved from the second position to the first position. Further, since the first operation portions 51 receive the force from the interference units 77 in a balanced manner in the left-to-right direction when the drum unit 4 is moved from the pulled out position to the accommodated position, the drum unit 4 does not incline in the left-to-right direction. Accordingly, the movement of the drum unit 4 from the pulled out position to the accommodated position is not inhibited by the interference units 77.

Further, two second operation portions 52 are provided on each toner cartridges 21 with an interval in the left-to-right direction. In other words, the second operation portions 52 are disposed apart form each other in the axial direction of the main body portion 40. Hence, when the drum unit 4 moves from the accommodated position to the pulled out position, a force can be applied from the interference units 77 to the second operation portions 52 in a balanced manner in the left-to-right direction, Therefore, the first operation portions 51 can be smoothly moved from the third position to the fourth position. The drum unit 4 can be smoothly moved.

Thus, since the force can be applied to the second shutter 41 in a balanced manner in the left-to-right direction, the second shutter 41 can be opened and closed smoothly.

Further, a direction of the force applied to the first operation portions 51 for displacing the first operation portions 51 is substantially parallel to and opposite to a first moving direction in which the drum unit 4 is moved from the pulled out position to the accommodated position. Hence, when the drum unit 4 is moved from the pulled out position to the accommodated position and the interference units 77 abut the first operation portions 51, a direction of the force applied from the interference unit 77 to the first operation portions 51 is substantially parallel to and opposite to the first moving direction of the drum unit 4. As a result, the first operation portions 51 can be properly moved. At the time, impact applied to the roller 76 of the rail 70 supporting the drum unit 4 can be reduced.

Further, a direction of the force applied to the second operation portions 52 for displacing the second operation portions 52 is substantially parallel to and opposite to a second moving direction in which the drum unit 4 is moved from the accommodated position to the pulled out position. Hence, when the drum unit 4 is moved from the accommodated position to the pulled out position and the interference units 77 abut the second operation portions 52, a direction of the force applied from the interference unit 77 to the second operation portions 52 is substantially parallel to and opposite to the second moving direction of the drum unit 4. As a result, the second operation portions 52 can be properly moved. At the time, impact applied to the roller 76 of the rail 70 supporting the drum unit 4 can be reduced.

Further, the second operation portions 52 are displaced from the fourth position to the third position with the displacement of the first operation portions 51 from the second position to the first position. In contrast, the first operation portions 51 are displaced from the first position to the second position with the displacement of the second operation portions 52 from the third position to the fourth position. Hence, the first operation portions 51 and the second operation portions 52 can be moved in conjunction with each other.

The first operation portions 51 located at the second position and the second operation portions 52 located at the third position are positioned below the second reference surface S2 and above the first reference surface S1. Thereby, by positioning the interference units 77 below the second reference surface S2 and above the first reference surface S1, the interference units 77 can abut against the first operation portions 51 located at the second position and the second operation portions 52 located at the third position. Therefore, the first operation portions 51 and the second operation portions 52 can be surely displaced.

The first operation portions 51 located at the first position and the second operation portions 52 located at the fourth position are located below the first reference surface S1. Thereby, the first operation portions 51 located at the first position and the second operation portions 52 located at the fourth position do not abut against the interference units 77 and do not block the movement of the drum unit 4. Thus, the smooth movement of the drum unit 4 can be ensured.

The exposure unit 10 for exposing the surface of the photosensitive drums 6 is provided in the main body casing 2. A portion of each interference unit 77 overlaps with the exposure unit 10 in the front-to-rear direction. Thereby, since at least a part of each interference unit 77 can be disposed at a space for disposing the exposure unit 10 as viewed in the front-to-rear direction, an increase in size of the printer 1 in the vertical direction can be restrained. Further, since the interference units 77 are configured by members different from the exposure unit 10, impact generated when the interference units 77 abut the first operation portions 51 and the second operation portions 52 have no effect on the exposure unit 10.

The interference units 77 are located at the front side with respect to the exposure unit 10 in the front-to-rear direction. In other words, the interference units 77 is disposed downstream of the exposure unit 10 in a pulled out direction in which the drum unit 4 is pulled out front the main body casing 2. In order to open the second shutters 41 of all the toner cartridges 21, when the drum unit 4 is moved from the pulled out position to the accommodated position, the frontmost toner cartridge 21 needs to be moved to the rear side of the interference units 77. Since the interference units 77 are positioned at the front end portion of the main body casing 2, the movement distance of the drum unit 4 for opening all of the second shutters 41 can be reduced. As a result, the size of the printer 1 in the front-to-rear direction can be reduced.

Further, when the second shutter 41 is in the open position, disengagement of the toner cartridge 21 from the drum unit 4 is regulated by the slide guide portions 23. Thereby, the toner cartridge 21 can be prevented from being disengaged from the drum unit 4 in a state the second shutter 41 is in the open position. Thus, when the toner cartridge 21 is disengaged from the drum unit 4, the toner can be surely prevented from spilling from the toner cartridge 21 through the second communication openings 42.

The main body casing 2 is provided with the roller member 76 and the upper side portion 71 with a space therebetween in the front-to-rear direction. The drum unit 4 is supported by the roller member 76 and the upper side portion 71. Each interference unit 77 is located between the roller member 76 and the upper side portion 71 in the front-to-rear direction. Thereby, when the interference unit 77 abuts the first operation portion 51 or the second operation portion 52, a force applied from the interference unit 77 to the first operation portion 51 or the second operation portion 52, is transferred to the drum unit 4 through the developing frame 20 of the toner cartridge 8, and is received at two points of the roller member 76 and the upper side portion 71. Thus, when the interference unit 77 abuts the first operation portion 51 or the second operation portion 52, the drum unit 4 can be prevented from dropping off the main body casing 2, and the printer 1 can be prevented from being inclined by losing its weight balance.

Each pair of sensors 85 detects the toner amount contained in the corresponding toner cartridge 21. Then, when the toner amount detected by the sensors 85 in the toner cartridge 21 is less than the predetermined amount, the interference units 77 are moved to the abutting position where the interference units 77 can abut the first operation portions 51 and the second operation portions 52. Therefore, since the interference units 77 can abut the first operation portions 51 and the second operation portions 52 certainly when the toner cartridge 21 needs to be replaced, the second shutter 41 can be surely closed.

When the toner amount detected by the sensors 85 in the toner cartridge 21 is equal to or more than the predetermined amount, the interference units 77 is moved to the retreat position where the interference units 77 cannot abut the first operation portions 51 and the second operation portions 52. When a paper jam of the sheet P is occurred on the conveyer belt 12, the drum unit 4 needs to be pulled out from the main body casing 2, but the second shutter 41 does not need to be opened. In such a case, since the second shutter 41 is not opened by the interference units 77 positioned at the retreat position, the second shutter 41 can be prevented from unnecessarily opening.

8. Modified Embodiment

While the invention has been described in detail with reference to specific embodiments thereof, it would be apparent to those skilled in the art that many modifications and variations may be made therein without departing from the spirit of the invention, the scope of which is defined by the attached claims.

For example, the toner cartridge 21 can be attached to and detached from the developing frame 20, but may be provided so as to be capable of being attached to and detached from the drum side plates 60 of the drum unit 4. In this case, a guide portion for guiding the toner cartridge 21 to the corresponding developing frame 20 is provided at the inner side surface of the drum side plates 60. Hence, each of the toner cartridges 21 can be replaced in relation to the corresponding developing frame 20.

Figure 11:
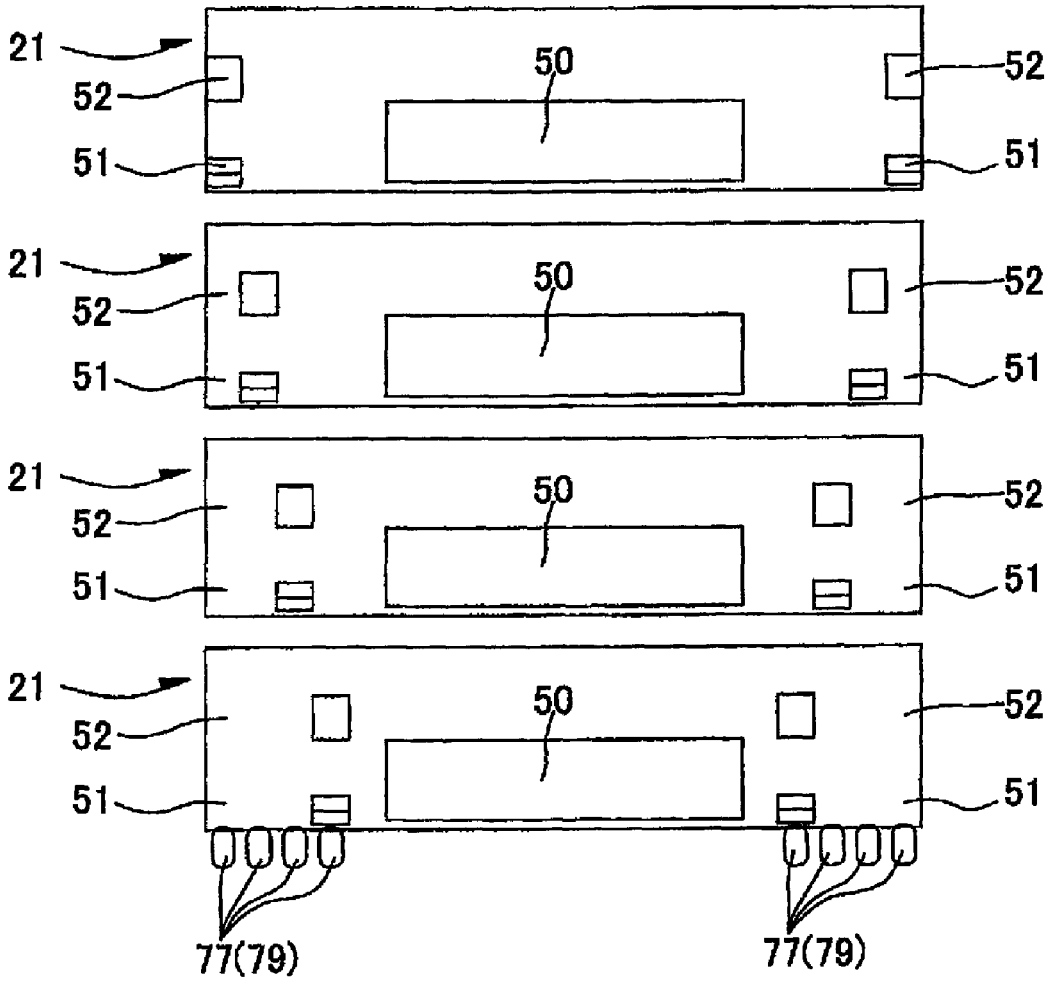
FIG. 11 is a schematic plan view showing the toner cartridges mounted on the drum unit according to according to a modification to the present embodiment.

In the above embodiment, the first operation portions 51 and the second operation portions 52 of each toner cartridge 21 are aligned in the front-to-rear direction shown in FIG. 5. However, as shown in FIG. 11, the first operation portions 51 and the second operation portions 52 of each toner cartridge 21 may be located at different positions from one another in the left-to-right direction. In other words, the first operation portions 51 and the second operation portions 52 of each toner cartridge 21 may be located at positions that are out of alignment with one another in the front-to-rear direction.

In this case, the pairs of interference units 77 (the abutting portions 79) are provided at positions each corresponding to the first operation portions 51 and the second operation portions 52 of each toner cartridge 21. Hence, four pairs of the interference units 77 (the abutting portions 79) are provided as shown in FIG. 11. Therefore, only the toner cartridge 21 determined that the toner amount detected by the sensors 85 is less than the predetermined amount is selected to open and close the corresponding second shutter 41. Further, since the second shutter 41 of the toner cartridge 21 remains to be opened, the toner cartridge 21 cannot be disengaged from the developing unit 20 by the slide guide portions 23. Therefore, the toner cartridge 21 having the toner amount equal to or more than the predetermined amount can be prevented from being erroneously replaced.

What is claimed is:

1. An image forming apparatus comprising:

a main body casing;

a holder unit configured to be movable between an accommodated position where the holder unit is accommodated in the main body casing and a pulled out position where the holder unit is pulled out from the main body casing in a predetermined direction;

a plurality of photosensitive drums configured to be held by the holder unit and juxtaposed with each other with an interval between neighboring photosensitive drums in the predetermined direction;

a plurality of developing units configured to be held by the holder unit and each corresponding to each photosensitive drum to develop the corresponding photosensitive drum; and a plurality of toner cartridges detachably attached to the holder unit when the holder unit is in the pulled out position and each corresponding to each developing unit to supply toner, each of the toner cartridges comprising:

a case containing the toner and formed with an opening at a position confronting the corresponding developing unit in a state that the toner cartridge is attached to the holder unit;

a shutter movable between a block position where the shutter blocks the opening and an open position where the shutter opens the opening;

a first operation portion provided on the shutter and movable between a first position and a second position, the shutter being located at the open position when the first operation portion is located at the first position, the shutter being located at the block position when the first operation portion is located at the second position; and a second operation portion provided on the shutter and movable between a third position and a fourth position, the shutter being located at the open position when the second operation portion is located at the third position, the shutter being located at the block position when the second operation portion is located at the fourth position, and an interference unit that is configured such that the first operation portions abut the interference unit to be displaced from the second position to the first position when the holder unit is moved from the pulled out position to the accommodated position and such that the second operation portions abut the interference unit to be displaced from the third position to the fourth position when the holder unit is moved from the accommodated position to the pulled out position.

2. The image forming apparatus according to claim 1, wherein the first operation portion and the second operation portion are aligned in the predetermined direction.

3. The image forming apparatus according to claim 1, wherein each photosensitive drum defines an axial direction, wherein the first operation portion is provided with at least two first operation portions disposed apart from each other in the axial direction, and wherein the second operation portion is provided with at least two second operation portions disposed apart from each other in the axial direction.

4. The image forming apparatus according to claim 1, wherein the holder unit is movable with respect to the main body casing in a moving direction, wherein the interference unit applies a first force to the first operation portion in a first direction when the first operation portion is displaced from the second position to the first position by the interference unit, wherein the interference unit applies a second force to the second operation portion in a second direction when the second operation portion is displaced from the third position to the fourth position by the interference unit, wherein the first direction and the second direction are substantially parallel to the moving direction.

5. The image forming apparatus according to claim 1, wherein the second operation portion is displaced from the fourth position to the third position with the displacement of the first operation portion from the second position to the first position, and wherein the first operation portion is displaced from the first position to the second position with the displacement of the second operation portion from the third position to the fourth position.

6. The image forming apparatus according to claim 1, wherein the holder unit is movable with respect to the main body casing in a moving direction and each photosensitive drum defines an axial direction, wherein the first operation portion located at the first position and the second operation portion located at the fourth position are positioned below a reference surface parallel to the moving direction and the axial direction, and wherein the first operation portion located at the second position and the second operation portion located at the third position are positioned above the reference surface.

7. The image forming apparatus according to claim 1, further comprising an exposure unit configured to expose a surface of each photosensitive drum and provided in the main body casing, wherein a portion of the interference unit overlaps with the exposure unit in the predetermined direction.

8. The image forming apparatus according to claim 7, wherein the holder unit is pulled out from the main body casing in a pulled out direction in which the holder unit is moved from the accommodated position to the pulled out position, and wherein the interference unit is positioned downstream of the exposure unit in the pulled out direction.

9. The image forming apparatus according to claim 1, further comprising a regulating member that regulates disengagement of the toner cartridge from the holder unit when the shutter is located at the open position.

10. The image forming apparatus according to claim 1, wherein the holder unit is movable with respect to the main body casing in a moving direction, and wherein the main body casing is provided with a first supporting portion and a second supporting portion with a space therebetween in the moving direction for supporting the holder unit with respect to the main body casing, the interference unit being located between the first supporting portion and the second supporting portion in the moving direction.

11. The image forming apparatus according to claim 1, wherein the holder unit is provided with a guide portion that guides each toner cartridge when each toner cartridge is attached to and detached from the holder unit, the guide portion being provided above the developing units.

12. The image forming apparatus according to claim 1, further comprising a detecting unit configured to detect an amount of the toner contained in each toner cartridge, wherein, when the toner amount detected by the detecting unit is less than a predetermined amount, the interference unit is moved to a abutting position where the interference unit is capable of abutting the first operation portion and the second operation portion, and wherein, when the toner amount detected by the detecting unit is equal to or more than the predetermined amount, the interference unit is moved to a retreat position where the interference unit is incapable of abutting the first operation portion and the second operation portion.

13. The image forming apparatus according to claim 12, the interference unit is provided with a plurality of interference units each corresponding to each toner cartridge.

* * * * *